United States Patent [19]

Slack et al.

[11] 4,047,314

[45] Sept. 13, 1977

[54] DISPLAY DEVICE WITH SLIDING BACK PLATES

[75] Inventors: Roger A. Slack; Gerald W. Michel, both of Milwaukee, Wis.

[73] Assignee: Everbrite Electric Signs, Inc., Milwaukee, Wis.

[21] Appl. No.: 682,946

[22] Filed: May 3, 1976

[51] Int. Cl.[2] ..... G09F 9/30; G09F 11/29

[52] U.S. Cl. ..... 40/28 C; 40/36

[58] Field of Search ..... 40/28 C, 36, 106.52, 40/106.53, 130 E, 133 R, 133 A

[56] References Cited

U.S. PATENT DOCUMENTS

| | | | |
|---|---|---|---|
| 1,114,267 | 10/1914 | Jones | 40/28 C |
| 1,172,360 | 2/1916 | Hildburgh | 40/28 C |
| 1,594,703 | 8/1926 | Ballerini | 40/28 C |
| 3,399,475 | 9/1968 | Rinder | 40/28 C |
| 3,742,631 | 7/1973 | Hasala | 40/36 X |
| 3,783,539 | 1/1974 | Trame | 40/28 C |
| 3,961,434 | 6/1976 | Sampon | 40/36 X |

FOREIGN PATENT DOCUMENTS

| | | | |
|---|---|---|---|
| 772,365 | 11/1967 | Canada | 40/28 C |

*Primary Examiner*—John F. Pitrelli

*Attorney, Agent, or Firm*—Wheeler, Morsell, House & Fuller

[57] ABSTRACT

An opaque face plate has arrays of openings which are arranged to depict numerals when light is transmitted through predetermined openings. A plurality of back plates are slideably mounted behind the face plate, each back plate having an array of light passages, some of which are elongated slots, and said light passages being arranged to coact with face plate openings to form numerals. Some of the face plate openings are arranged in upright line formation, and the slots are inclined at a relatively small acute angle with respect to said upright lines. Each back plate is slideable in a direction defined by the direction of the inclined slots, and is moved back and forth in intermittent steps along its path of movement to cause the numerals to change in accordance with the time of day.

6 Claims, 12 Drawing Figures

Fig. 3
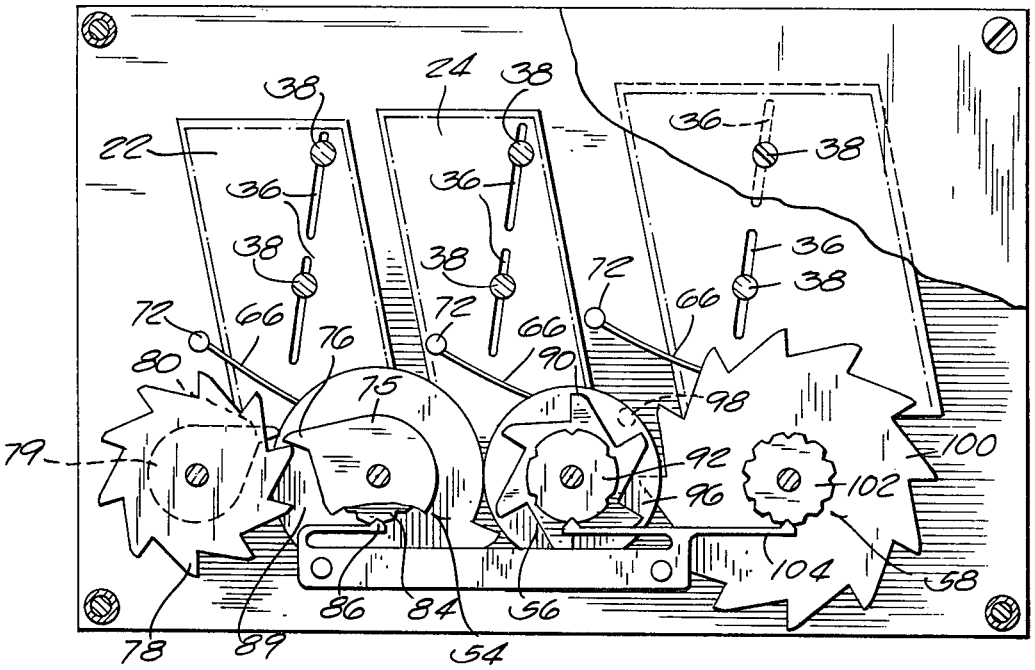
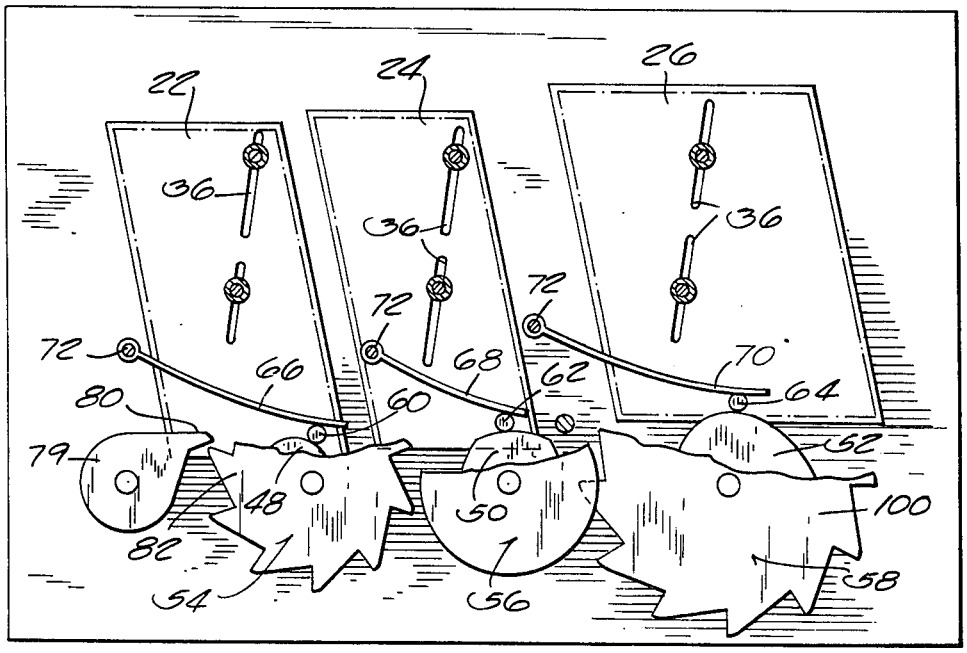
Fig. 4

Fig. 5
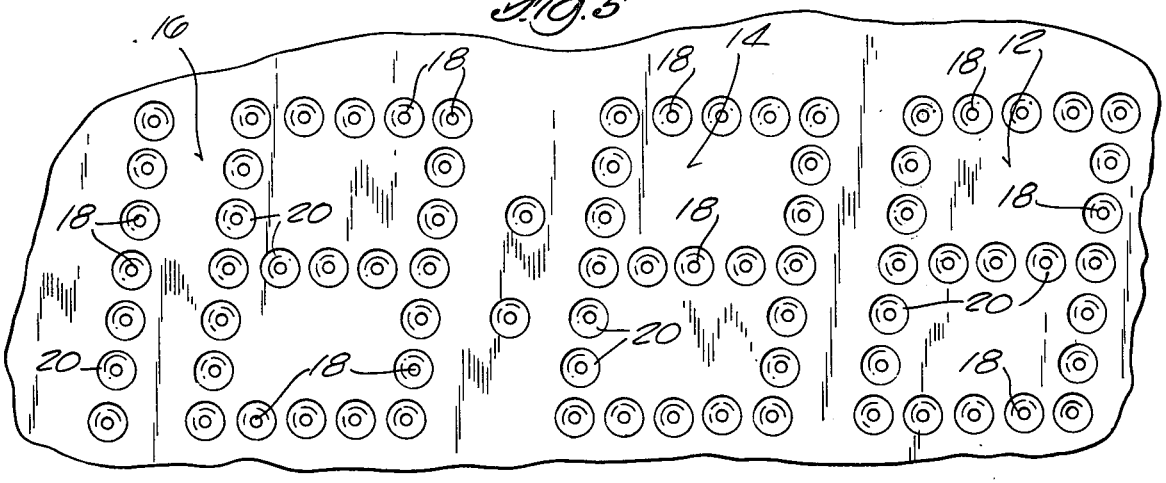
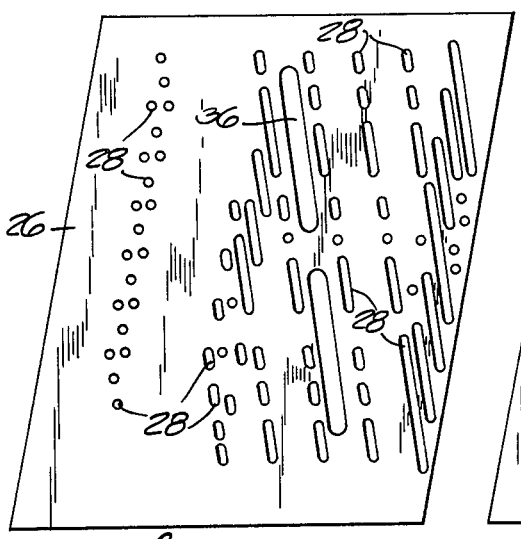
Fig. 6A
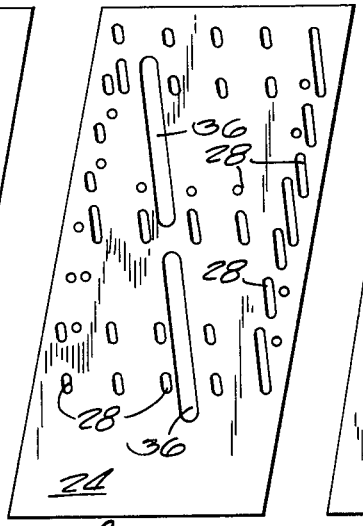
Fig. 6B
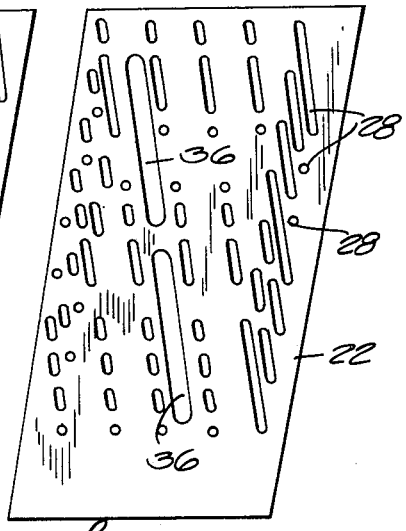
Fig. 6C
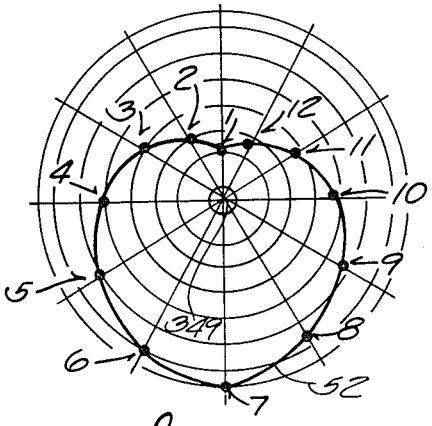
Fig. 8A
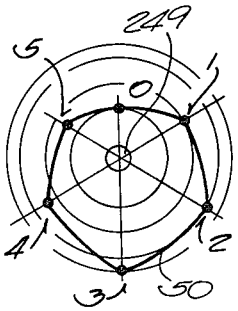
Fig. 8B
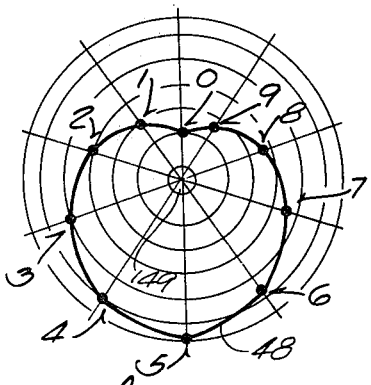
Fig. 8C

DISPLAY DEVICE WITH SLIDING BACK PLATES

BACKGROUND OF THE INVENTION

This invention relates to display devices which include a face plate having arrays of openings therein which are arranged to form numerals, letters, or other indicia when light is transmitted through predetermined openings, and having a plurality of back plates movably mounted behind the face plate, each back plate having an array of light passages therein which are arranged to coact with the corresponding face plate openings to form the corresponding indicia. One example of a prior art display device of this general type is disclosed in U.S. Pat. No. 3,401,280. The above-noted patent discloses a digital clock having three back plates which are driven in an orbital path by an orbital drive mechanism. In practice, the above-described prior art orbital drive mechanism has been found to have a tendency to stick, with the possibility of stopping the clock.

Ballerini U.S. Pat. No. 1,594,703 and Hildburgh U.S. Pat. No. 1,172,360 disclose display devices having linear movement. In Ballerini there is a limit to the number of message changes which is possible and in Hildburgh a multiplicity of movable panels, one behind the other, is required.

One important object of this invention is to provide an improved back plate drive mechanism which is not subject to sticking.

Another important object of this invention is to replace the prior art orbital drive mechanism with a simpler, sturdier linear drive mechanism and to provide a device in which a relatively large number of indicia changes in possible with only one movable back plate.

Other objects, advantages, and features of the invention will be apparent from the disclosure hereof.

SUMMARY OF THE INVENTION

An opaque face plate has at least one array of openings therein which is arranged to form numerals, letters, or other indicia when light is transmitted through predetermined openings. An opaque back plate is slidably mounted behind the face plate and has an array of light passages therein, some of which are elongated slots, the light passages being arranged to coact with the corresponding face plate openings to form the corresponding indicia. The back plate is slidable in a direction defined by the direction of the slots and is moved back and forth in intermittent steps along its path of movement to cause the indicia to periodically change.

DESCRIPTION OF THE DRAWINGS

FIG. 3 is a back elevational view, with parts broken away.

FIG. 4 is another back elevational view, somewhat similar to FIG. 3 but with more portions broken away.

FIG. 5 is an enlarged elevational view of the digital read-out of the embodiment shown in FIGS. 1-4.

FIGS. 6A-6C are enlarged front elevational views of the three back plates which coact with the digital read-out of FIG. 5, each back plate being positioned below the portion of the digital read-out that it coacts with.

FIGS. 8A-8C are diagrams in polar coordinates showing how the shape of the three cams which raise and lower the back plates is determined.

DETAILED DESCRIPTION OF THE INVENTION

Figure 1:
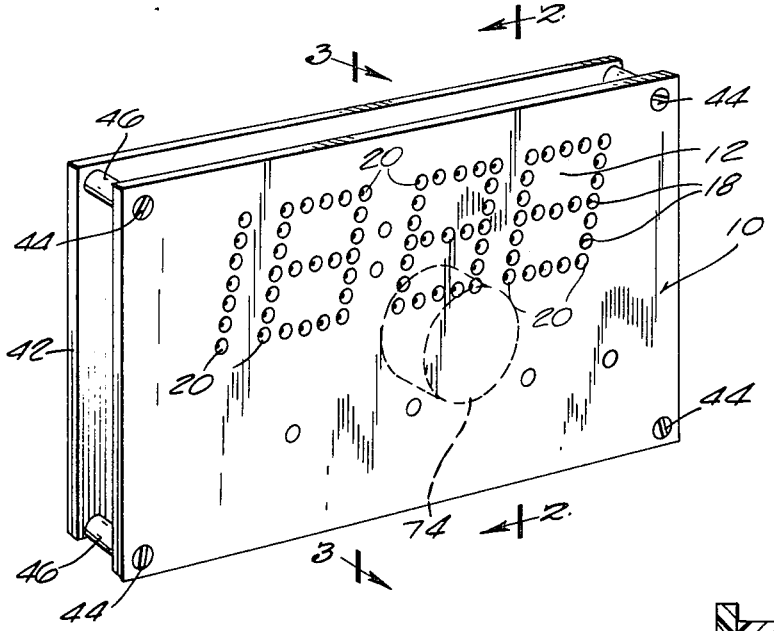
FIG. 1 is a front perspective view of one embodiment of the invention.

FIGS. 1-7 show the invention embodied in a digital clock, as illustrative of one embodiment. Referring to FIGS. 1 and 5, this clock has an opaque face plate 10 having three arrays 12, 14, and 16 of openings 18 therein which are arranged, during use, to form various digits of a digital time read-out. Openings 18 are chamfered on their front face, as shown at 20 in FIG. 2, to adapt face plate 10 to receive a plurality of lenses, not shown, for magnifying purposes, to improve the read-out.

Three opaque back plates 22, 24, and 26 (FIG. 3) are slidably mounted behind face plate 10, each of the back plates 22-26 having an array of light passages 28 therein, some of which are elongated slots of varying length. The light passages 28 of each back plate 22-26 are positioned to coact with the face plate openings 18 of a superimposed array 12-16 of face plate openings to form digits by permitting light to pass through selected openings 18, which form the desired digit, while blocking the passage of light through the other openings 18.

Figure 7:
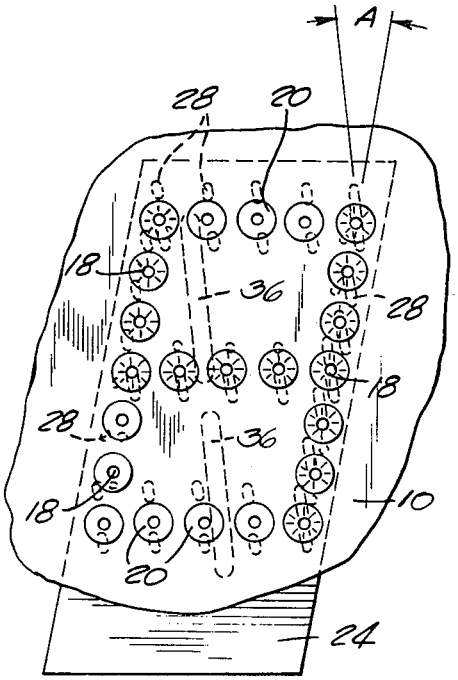
FIG. 7 is an enlarged detail view of one portion of the digital read-out of FIG. 5 showing the relationship between the openings in the face plate and the slots in the back plate which is required to produce a read-out of the digit 4.

FIG. 7 shows the coacting arrangement of openings 18 and light passageways 28 that form the digit 4, the blackened opening 18 indicating those openings through which the passage of light is blocked by the opaque portions of back plate 22, and the unblackened openings 18 indicate the openings through which light can pass due to the alignment of openings 18 and light passageways 28. The unblackened openings 18 form the digit 4 in the example shown in FIG. 7. To form the digit 3, back plate 22 is moved downward by one step in a direction parallel to the direction of extent of light passageway slots 28. The slots 28 are all parallel to each other, but are inclined at a relatively small acute single A with respect to the upright line 30, which line is parallel to one of the upright rows of openings 18 as illustrated in FIG. 7. The light passageways 28 are arranged to cause depiction of the digits 0-9 in sequence as back plate 22 is raised and lowered in intermittent steps along lines parallel to the light passageway slots 28.

The light passageways 28 of back plate 24 are arranged so that the digits 0-5 are depicted as back plate 24 is raised and lowered in steps while the light passageways 28 of back plate 26 are arranged so that the numbers 1-12 are depicted as back plate 26 is raised and lowered in steps. Thus, in the illustrated embodiment, when the back plates are raised and lowered in the proper sequence, they cause depiction of a digital read-out that indicates the time of day.

Back plates 22-26 are slidably mounted adjacent to the rear surface of face plate 10 by the use of pins 32 (FIG. 2) which are seated in recesses 34 in the back of face plate 10 and engage in corresponding slots 36 (FIG. 3) in back plates 22-26 in a manner to allow the plates to slide up and down. Each pin 32 is carried on one end of a cylindrical support 38 (FIG. 2) which is attached by a screw 40 to a rear housing plate 42. Rear housing plate 42 is held in space relation with respect to face plate 10 by screws 44 which engage opposite ends of spacers 46. When a rearwardly-spaced source of light is relied on, rear housing plate 42 is made of a transparent plastic material to permit light to pass therethrough to illuminate openings 18 and form the above-described digital read-out. The light may come from a fluorescent lamp, not shown, mounted on a suitable supporting structure behind rear housing plate 42, but such source of light could be located between the plates 10 and 12.

Figure 2:
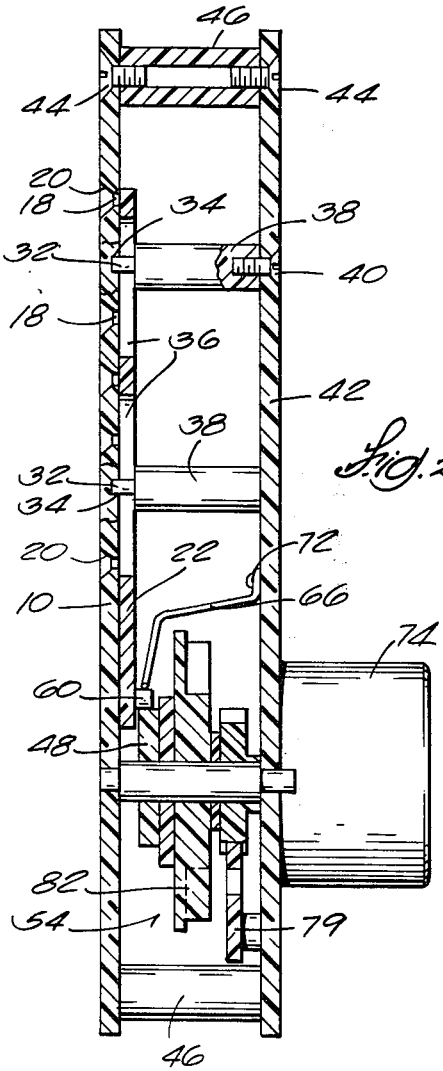
FIG. 2 is a cross-sectional view taken on the plane 2—2 of FIG. 1.

Back plates 22–26 are adapted to be moved up and down by cams 48, 50, and 52 (FIG. 4), respectively, which are rigidly mounted on rotatable wheel assemblies 54, 56, and 58. Cams 48, 50, and 52 act on cam follower pins 60, 62, and 64 which are rigidly attached to the bottom of back plates 22–26, respectively, and are held thereagainst by springs 66, 68, and 70. Springs 66–70 are fastened to the inside surface of rear housing plate 42 by screws 72 (FIG. 2).

Cams 48, 50, and 52 have peripheries which are shaped as shown in FIGS. 8A through 8C. FIG. 8C shows the shape of cam 48, which is designed to raise the corresponding back plate 22 in five steps, which steps are angularly spaced apart by 36°, considering the circles shown in FIG. 8C with the center 149, and then to lower back plate 22 in five steps, also spaced 36° apart, back to its starting point. As shown in FIG. 8C, each step 1–5 is one concentric circle outwardly in a radial direction from the next adjacent step, and each step 6–0 is one concentric circle inwardly from the next adjacent step. At each of the numbered points in FIG. 8C, the light passages 28 in back plate 22 (FIG. 6C) are arranged to cause a digit, corresponding to the numbered position in FIG. 8C, to be displayed through face plate openings 18 in the manner described above in connection with FIG. 7.

Each step in the rotation of cam 48 from 0 to 4 is equal in the amount of radial outwardly movement, but the step from 4–5 is only equal to one-half the steps from 0 to 4. (Note that the spacing of the outermost of the concentric circles is only one-half of the spacing of the other concentric circles). The radial spacing of the steps from 5 to 9 are equal, and equal to the radial spacing between the steps from 0 to 4, but the step from 9 to 0 is equal to only one-half the radial distance as the steps from 0 to 4. However, because of the one-half steps between 4 and 5, the steps 6 to 9 fall between the steps from 0 to 4. This arrangement enables the individual digits to be displayed in sequence while at the same time enabling back plate 22 to be lowered by relatively small steps instead of in one large step all at once. If the individual digits were all displayed on an ascending curve of cam 48, back plate 22 would have to be abruptly dropped back to its starting point, which would produce an audible noise. When half of the digits are displayed on an ascending curve of the cam and the other half are displayed on the descending curve, this undesirable result is eliminated.

In a typical case, the radial steps of rise from 0 to 4 (FIG. 8C) and the radial steps of drop from 5 to 9, are equal to 0.016 inches each, while the steps from 4 to 5 and from 9 to 0 are equal to 0.080 inches each. The particular dimensions are, however, merely given as an example, and larger or smaller steps can be employed if desired.

Cam 50 (FIG. 8B) is shaped to provide three ascending steps (0–3) and three descending steps (3–0) which are angularly separated by 60° each with respect to center 249. The radial spacing in steps 0 to 1, 1 to 2, 3 to 4, and 4 to 5 is equal, while the radial spacing from 2 to 3 and from 5 to 0 are equal to one-half the radial spacing in the other steps (FIG. 8B) for the reason described heretofore.

Cam 50 raises and lowers back plate 24, whose light passsages 28 are arranged to cause digits 0–5 to be displayed on the corresponding array of face plate openings 18.

Cam 52 (FIG. 8A) is shaped to provide six ascending steps (1–7) and six descending steps (7–1) which are angularly separated by 30° each with respect to the center 349. The radial spacing in each of the steps 1–6 and 7–12 is equal, while the radial spacing from 6–7 and from 12–1 is equal to one-half of the radial spacing for the other steps for the reasons heretofore described. Cam 52 (FIG. 8A) raises and lowers back plate 26, whose light passages 28 are arranged to cause the numbers 1–12 to be displayed on the corresponding array of face plate openings 18.

Wheel assemblies 54, 56, and 58 (FIGS. 3 and 4) are rotated in steps by a progressive incremental drive system which includes an electric motor 74 (FIG. 2). The shaft of motor 74 rotates a disc 75 having a projecting drive finger 76 (FIG. 3) which coacts with a toothed wheel 78 to turn wheel 78 by one-tenth of a revolution for every full revolution of drive finger 76. Drive finger 76 is not connected to wheel assembly 54, even though it is coaxial with wheel assembly 54, but rather rotates independently. Wheel 78 rotates another disc 79 having a projecting drive finger 80, the latter coacting with another toothed wheel 82 (FIG. 4) which is rigidly mounted on the same shaft as cam 48 and therefore causes cam 48 to rotate with it. Wheel 82 has ten teeth and moves one-tenth of a revolution for each complete revolution of drive finger 80. Each increment of rotation of wheel 82 is held in indexed position by a notched disc 84 (FIG. 3) which coacts with a flexible pawl 86 which bears against the periphery of disc 84 and has a triangular end that interacts with the notches in disc 84.

Notched disc 84 has ten notches which are angularly spaced apart by 36° from each other and are positioned to correspond to the 10 positions of cam 48 shown in FIG. 8C. This insures that cam 48 will move from one numbered position in FIG. 8C to the next numbered position thereof. (FIGS. 8A–8C are front view of cams 48–52, while FIGS. 3 and 4 are back views thereof.) As cam 48 rotates from one indexed position to another, back plate 28 rises or falls correspondingly and causes the corresponding digit to be displayed in the digital read-out array 12 (FIG. 1).

A disc 89 having a drive finger 88 (FIG. 3) is rigid on the shaft for wheel assembly 54 and rotates with cam 48 and wheel 82. Drive finger 88 coacts with a wheel 90 which is rigid on the shaft for wheel assembly 56 and rotates therewith. Wheel 90 has six teeth and rotates one-sixth of revolution, or 60°, for each complete revolution of drive finger 88. Wheel assembly 56 has a notched disc 92 (FIG. 3) which coacts with a flexible pawl 94 to releasably hold wheel assembly 56 at 60° rotational increments to match the 60° rotational steps of cam 50 (FIGS. 4 and 8B). Thus cam 50 advances from one numbered position in FIG. 8B to the next for each full revolution of wheel assembly 54, i.e. for each ten digits thereof up to 59, after which cam 50 returns to its zero position and begins over. Each numbered position of cam 50 of FIG. 8B produces the corresponding digit in digital read-out array 14 (FIG. 1).

Wheel assembly 56 has a drive disc 96 (FIG. 3) with a drive peg 98 carried thereby for coaction with a toothed wheel 100, the latter being attached to wheel assembly 58 and adapted to rotate therewith. Wheel 100 has twelve teeth and rotates one-twelfth of a revolution (30° ) for each complete revolution of drive disc 96. Cam 52 (FIGS. 4 and 8A) rotates with wheel 100 and raises or lowers back plate 26 one step for each rotational step of cam 52. A notched indexing disc 102 and flexible pawl 104 releasably hold wheel assembly 58 to insure that cam 52 moves from one numbered position in FIG. 8A to the next.

What we claim is:

1. A display device comprising an opaque face plate having at least one array of openings therein arranged to represent predetermined indicia when light is transmitted through selected openings of said array, an opaque back plate slidably mounted behind said face plate and having an array of light passages therein, some of which are elongated slots which are of substantially greater length than the corresponding dimension of openings in the face plate, means guiding said back plate for reversible stepped sliding movement in a predetermined lineal direction that corresponds with the direction in which said elongated slots extend, portions of said light passages in said back plate permitting light to be transmitted through selected openings of said face plate while said opaque back plate blocks the transmission of light through other openings and said slots being arranged so some will be between openings in said face plate while other of said slots are coincident with corresponding openings, thereby forming selected indicia, some of said face plate openings being arranged in a line extending in one direction and said elongated slots being arranged in rows each comprising slots of varying length, said rows being parallel to each other and inclined at an acute angle relative to said line, and drive means coupled to said back plate for shifting said back plate linearly, said elongated slots being so disposed relative to said face plate openings that when the back plate is shifted in its guided path there is a change in the selection of openings in the face plate through which light is permitted to pass, thereby changing said indicia.

2. The display device of claim 1 wherein said drive means comprises a cam rotatably mounted adjacent to said back plate and having cam portions at varying distances from its axis of rotation, a cam follower on said back plate engaging a cam portion, and shifting means for intermittently shifting the follower-engaged portion of said cam in steps from one position about the axis of rotation of the cam to another to thus shift said back plate linearly and bring about a change in indicia for each shifted step.

3. The display device of claim 2 and further comprising means for releasably indexing said cam.

4. The display device of claim 2 wherein said drive means includes a toothed wheel rotatable with said cam and having one tooth for each of said shifted cam positions, and a drive finger movably supported in a position to periodically engage said toothed wheel to shift said cam from one of said shifted positioned to the next.

5. The display device of claim 2 wherein said cam portions are on the cam periphery, and wherein said periphery is shaped to cause said back plate to move linearly in one direction during a first ascending sequence of shifted positions on the cam periphery and in a reverse direction during a second descending sequence of shifted positions, with said cam being shaped to cause the last shift of said first sequence and the last shift of said second sequence to move the cam follower only one-half as far radially from the axis of the cam as in the other shifting movements.

6. The display device is claim 1 wherein the display is a digital clock, wherein there are three arrays of said openings in said face plate and three of said opaque back plates each slidably mounted behind a corresponding array of openings, and wherein there is clock-type drive mechanism coupled to said back plates for shifting said back plates in proper correlation with one another so as to indicate the time of day.

* * * * *